US007033232B2

(12) United States Patent
Korherr et al.

(10) Patent No.: US 7,033,232 B2
(45) Date of Patent: Apr. 25, 2006

(54) ELECTRIC PLUG CONNECTOR

(75) Inventors: Joachim Korherr, Orsingen (DE); Karl Friedrich Brodbeck, Balingen (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 10/975,135

(22) Filed: Oct. 28, 2004

(65) Prior Publication Data

US 2005/0124230 A1 Jun. 9, 2005

(30) Foreign Application Priority Data

Oct. 31, 2003 (DE) ..... 103 51 099

(51) Int. Cl.
*H01R 13/33* (2006.01)

(52) U.S. Cl. ..... 439/840

(58) Field of Classification Search ..... 439/840, 439/819–820, 827, 62, 65–67, 630, 841, 439/637, 188

See application file for complete search history.

(56) References Cited

U.S. PATENT DOCUMENTS

| | | | | |
|---|---|---|---|---|
| 4,955,830 A | | 9/1990 | Fukumoto | |
| 4,969,824 A | * | 11/1990 | Casciotti | 439/62 |
| 5,013,267 A | * | 5/1991 | Watanabe | 439/821 |
| 5,092,781 A | * | 3/1992 | Casciotti et al. | 439/62 |
| 5,476,398 A | * | 12/1995 | de Givry et al. | 439/841 |

FOREIGN PATENT DOCUMENTS

| | | |
|---|---|---|
| DE | 22729 | 3/1962 |
| DE | 10019241 | 10/2001 |
| EP | 0105733 | 12/1988 |
| EP | 69306455 | 5/1997 |
| WO | WO95/31017 | 11/1995 |

OTHER PUBLICATIONS

Istvan Novak, Frequency-Domain Power-Distribution Measurements—An Overview, Manuscript for DesignCon East 2003, Jun. 2003, Boston, MA, 45 Pages, Sun Microsystems, Inc.

* cited by examiner

*Primary Examiner*—J. F. Duverne
(74) *Attorney, Agent, or Firm*—Tarolli, Sundheim, Covell & Tummino L.L.P

(57) ABSTRACT

An electric plug connector has two separate contact members. Each of the contact members has a first pair of parallel elongate webs spaced from each other and a second pair of elongate webs that extend in the same plane perpendicular to the first pair of webs. The first and second contact members are assembled so that the first pairs of webs of both contact members are aligned to define a first flat plug-in channel and the second pairs of webs of both contact members are spaced from each other and face each other to define a second flat plug-in channel perpendicular to and crossing the first plug-in channel. The two separate contact members are held in an assembled condition by a holding member tightly surrounding the contact members.

8 Claims, 4 Drawing Sheets

ELECTRIC PLUG CONNECTOR

FIELD OF THE INVENTION

The present invention relates to an electric plug connector.

BACKGROUND OF THE INVENTION

In order to optimally utilize the limited space available, in vehicles, flat plugs are installed in various orientations. Here, it is desirable not to be restricted right from the start in terms of the orientation of the flat plug. Plug connectors are known that can accommodate a flat plug in two orientations positioned perpendicularly with respect to each other.

BRIEF SUMMARY OF THE INVENTION

It is an object of the present invention to improve an electric plug connector.

For this purpose, an electric plug connector has two separate contact members. Each of the contact members has a first pair of parallel elongate webs spaced from each other and a second pair of elongate webs that extend in the same plane perpendicular to the first pair of webs. The first and second contact members are assembled so that the first pairs of webs of both contact members are aligned to define a first flat plug-in channel and the second pairs of webs of both contact members are spaced from each other and face each other to define a second flat plug-in channel perpendicular to and crossing the first plug-in channel. The two separate contact members are held in an assembled condition by a holding member tightly surrounding the contact members.

First of all, this configuration simplifies the production of the individual components of the plug connector and secondly, the contact force with which the flat plug is held can be adjusted through the configuration of the holding element, e.g. through the selection of the spring force of an elastic holding element.

The term "separate" is to be understood as meaning that, before the plug connector is assembled, the contact members and the holding element are separate components, independent of each other.

In a preferred embodiment of the invention, the holding element is a spring wire. This component is easy to produce, inexpensive and quick to install. The use of a metallic ribbon as the holding element entails the same advantages.

The holding element can be configured elastically to transmit a spring force to the contact surfaces so that a male connector can be held in a springy fashion, or it can be rigid to fix the contact member webs tightly to a contact, e.g. a flat plug.

In a preferred embodiment of the invention, the contact members have external cutouts aligned with each other to form a peripheral groove in the assembled condition for accommodation of the holding member. Especially in conjunction with an elastic holding element, this makes possible to create a detachment-proof locking mechanism for a correspondingly shaped male connector, e.g. a flat or cross-shaped plug. For this purpose, the male connector has, for example, a lateral groove into which the holding element latches when the male connector is in the correct position. The male connector can be a contact pin provided on a board of an electronic device to which the plug connector is connected.

Together, both plug-in channels form a cruciform cross section so that a flat plug can be accommodated in two different orientations positioned vertically with respect to each other. By the same token, of course, a male connector with a cruciform cross section can be inserted. The male connector can be engaged in both plug-in channels. Preferably, the holding element surrounds the contact members in a detachment-proof manner.

Preferably, each contact member pair contains two integrally connected segments. The contact members can be stamped from a blank and then deformed.

In a preferred embodiment, the contact members are assembled around a male connector partially engaged in at least one of the plug-in channels, the holding member also surrounding and engaging the male connector.

DETAILED DESCRIPTION OF PREFERRED EMBODIMENTS

Figure 1:
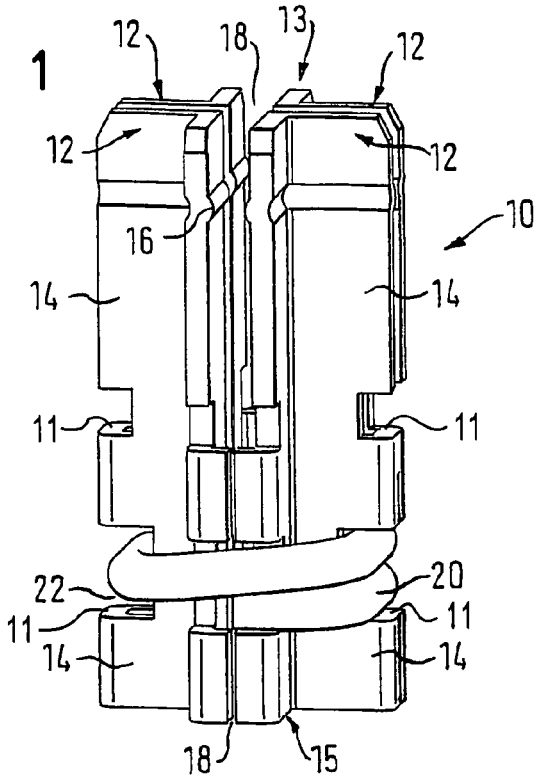
FIG. 1 shows a schematic perspective view of a plug connector according to the invention in a first embodiment.
Figure 2:
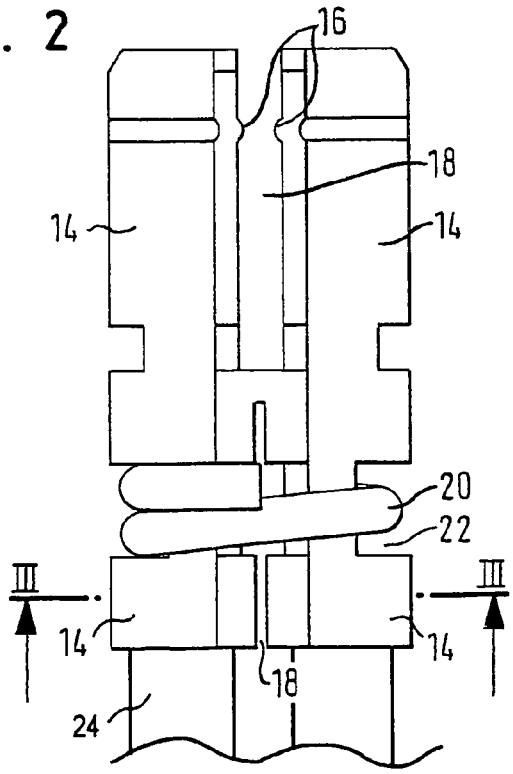
FIG. 2 shows a side view of the plug connector of FIG. 1.

FIG. 1 shows an electric plug connector 10 that consists of four segments 12. The four segments 12 are essentially identical. Each segment 12 has an angled contact section 14 at the upper longitudinal end 13 (in the figures) as well as at the lower longitudinal end 15 (in the figures). On each contact section 14, there are two electrically conductive contact surfaces 16 that taper towards each other.

Two adjoining segments 12 each form a first and a second contact member pair 17*a*, 17*b*. In each contact member pair 17*a*, 17*b* the segments 12 are integrally connected via bridges 11 arranged between the upper and lower contact surfaces 16. Each bridge 11 has a slit at the side directed towards the lower longitudinal end 15. Two segments 12 each are jointly stamped from a sheet metal and formed to one contact member pair 17*a*, 17*b*. Both contact members 17*a*, 17*b* are substantially identical.

Figure 3:
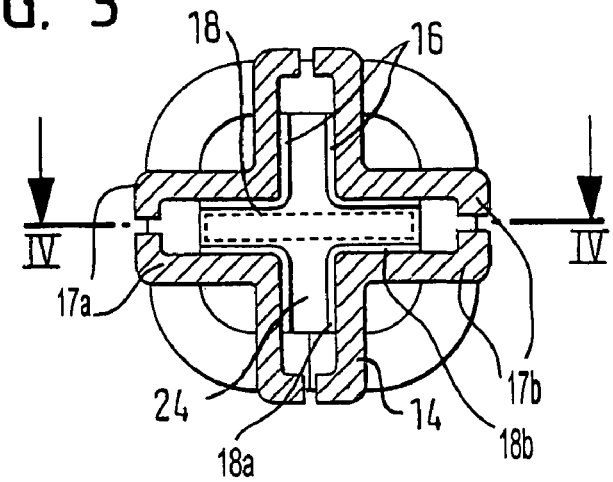
FIG. 3 shows a section along the line III—III of FIG. 2.
Figure 4:
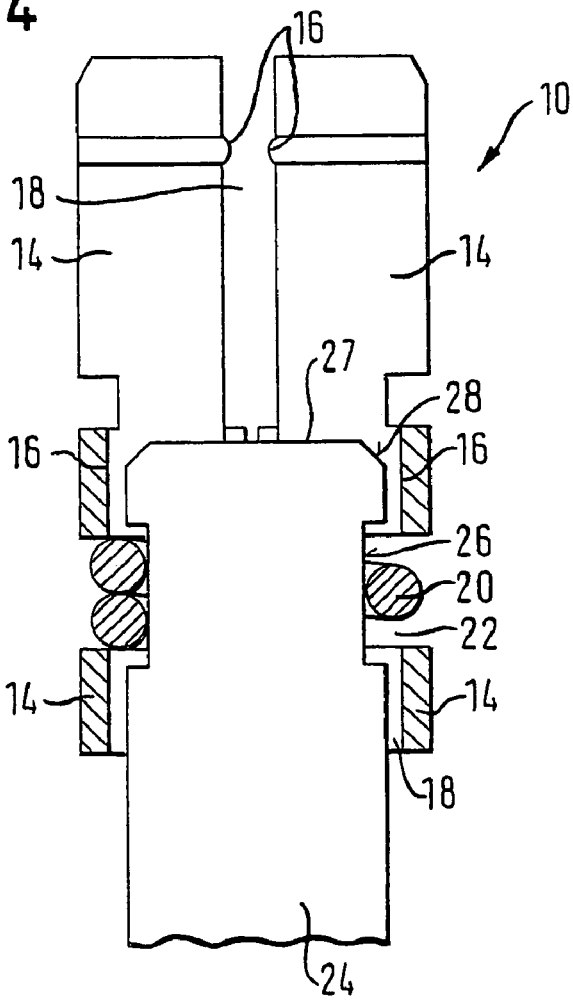
FIG. 4 shows a section along the line IV—IV of FIG. 3.
Figure 6:
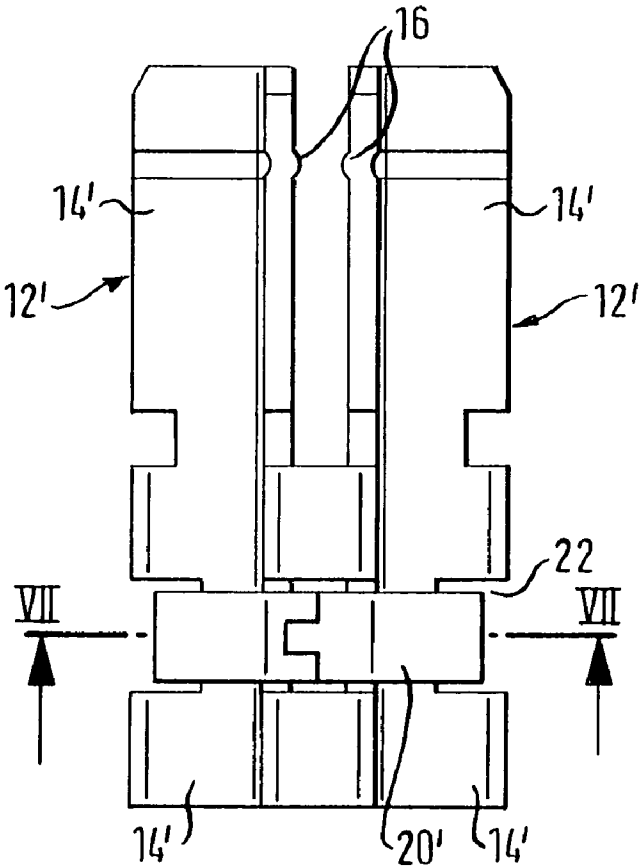
FIG. 6 shows a side view of the plug connector of FIG. 5.
Figure 5:
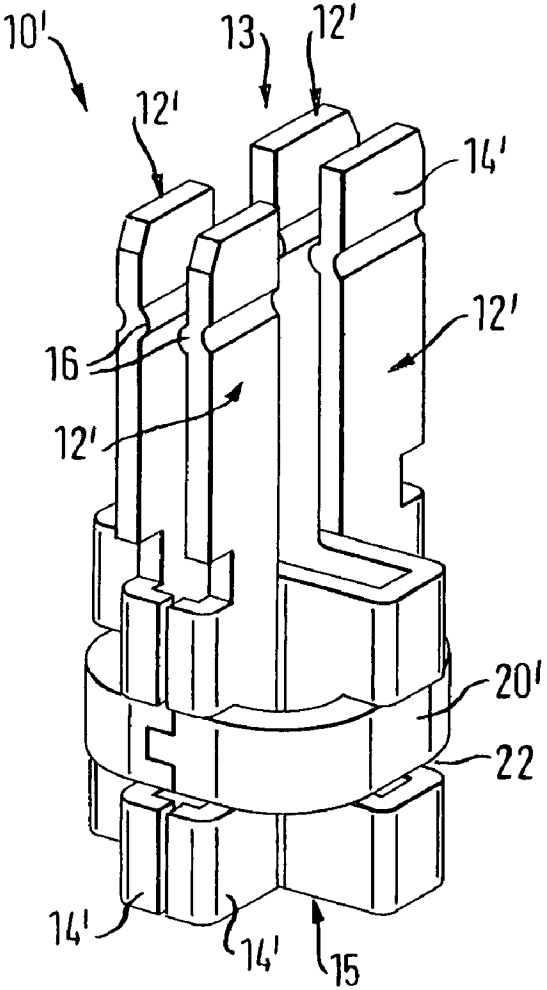
FIG. 5 shows a plug connector according to the invention in a second embodiment of the invention in a schematic perspective view.
Figure 8:
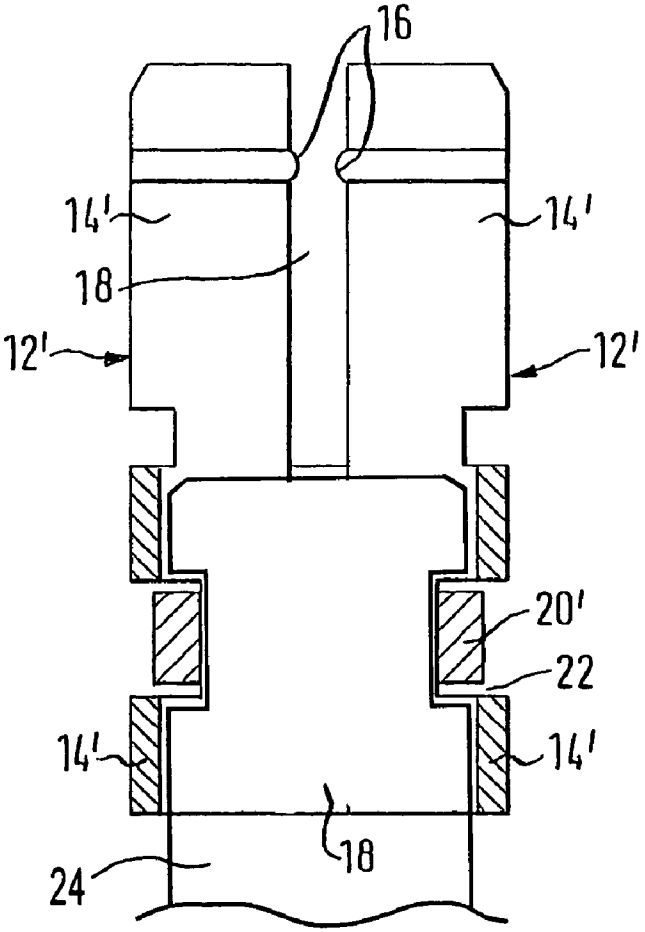
FIG. 8 shows a section along the line VIII—VIII of FIG. 7.
Figure 7:
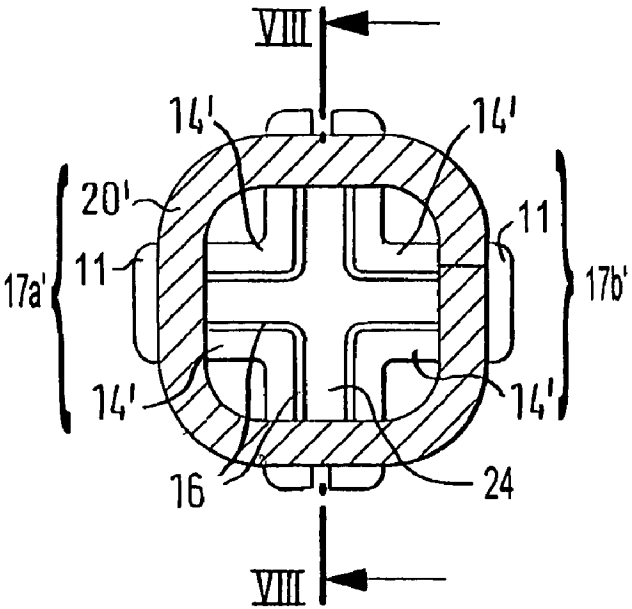
FIG. 7 shows a section along the line VII—VII of FIG. 6.

Each contact member pair 17*a*, 17*b* has a first pair of parallel elongate webs spaced from each other and a second pair of elongate webs extending in the same plane as the first and perpendicular to the first pair of webs, each web forming a contact surface 16. The contact members 17*a*, 17*b* are assembles so that the first pairs of webs of both contact members are aligned to define a first flat plug-in channel, which is given the reference number 18*a* in FIG. 3. The second webs of both contact members 17*a*, 17*b* are spaced from each other and face each other to define a second flat plug-in channel 18*b* perpendicular to and crossing the first plug-in channel 18*a*. The designation of the plug-in channels 18*a*, 18*b* and therewith of the first and second pair of webs of each contact member pair 17*a*, 17*b* in FIG. 3 is arbitrarily chosen and could be reversed.

Both plug-in channels 18*a*, 18*b* together form a plug-in channel 18 that has a cruciform cross section, that runs parallel to the lengthwise extension of the contact sections 14 and is delimited by the contact surfaces 16. The webs are provided at the upper and lower longitudinal end of the contact members 17*a*, 17*b*, respectively, so that plug-in channels 18, 18*a*, 18*b* are provided at each longitudinal end 13, 15 of the plug connector 10.

A male connector 24, which can be a flat plug, can be inserted into each plug-in channel 18, 18*a*, 18*b*. The contact surfaces 16 serve to establish the electric contact between the male connector 24 and the plug connector 10. Instead of a flat plug, it is also possible to use a male connector 24 with a cruciform cross section as is shown in FIG. 3. The male connector 24 is e.g. a contact pin arranged on a board of a electronic device.

In the first embodiment, the plug-in channels 18 at both longitudinal ends 13, 15 can accommodate both a flat plug (shown in broken lines in FIG. 3) and a male connector 24 with a cruciform section.

The two contact members 17*a*, 17*b* are connected by a holding element 20 that is separate from the contact members 17*a*, 17*b*. The individual contact members 17*a*, 17*b* are joined to each other here only via the holding element 20. Further connections, for example, made by welding, can be dispensed with. Moreover, the holding element 20 holds the contact members 17*a*, 17*b* together in a detachment-proof manner.

In the first embodiment shown, the holding element 20 is a spring wire that has a predefined elasticity. Thus, via the holding element 20, the force can be directly determined with which a plug inserted into the plug-in channel 18 is held by the contact surfaces 16.

The holding element 20 is arranged in the area of the lower longitudinal end 15 of the plug connector 10. In certain sections, the holding element 20 lies in each segment 12 in a section 22 provided there that passes through the wall of the contact section 14 so that the holding element 20 projects into the plug-in channel 18. The holding element 20 thus lies in a circumferential groove formed on the segments 12.

The holding element 20 here concurrently serves as a detachment-proof locking mechanism. The elasticity of the spring wire is utilized for this purpose. The narrow sides of the male connector 24 each have a groove 26 and the male connector 24 is provided with sliding surfaces 28 on its insertion end 27. The sliding surfaces 28 push the holding element 20 apart when the male connector 24 is inserted into the plug-in channel 18. As soon as the grooves 26 have reached the holding element 20, the latter snaps back and holds the male connector 24 in place.

While the plug connector is placed with its lower longitudinal end 15 on a male connector provided e.g. on a board, a conventional flat plug can be inserted into one of the plug-in channels 18, 18*a*, 18*b* located at the upper longitudinal end 13 of the plug connector 10.

In the example shown, a holding element 20 is provided only at the lower longitudinal end 15 of the plug connector 10. It would also be possible to provide a holding element 20 at the upper longitudinal end 13 and/or in the middle of the plug connector 10. It would also be conceivable to use several holding elements 20.

A second embodiment is shown in FIGS. 5 to 8.

Elements that are identical to elements of the first embodiment will continue to be designated with the same reference numerals introduced in the first embodiment.

The plug connector 10' according to the second embodiment likewise consists of four individual segments 12' forming two contact members 17*a*', 17*b*'. The segments 12 forming each contact member pair 17*a*', 17*b*' are connected integrally via a bridge 11. The two contact members 17*a*', 17*b*' are joined to each other only via a separate holding element 20'. In this case, the holding element 20' is made of a rigid metal ribbon.

Like in the first embodiment, the holding element 20' is arranged in the area of the lower longitudinal end 15 of the plug connector 10', namely, in such a way that it projects into the cutouts 22 into angled contact sections 14' leading into the plug-in channel 18.

In this case, the two contact members 17*a*', 17*b*' are assembled around the male connector 24 and then encircled by the holding member 20' and in this way fixedly and non-elastically connected to the male connector 24. The metal ribbon can be attached to the plug connector 10' by crimping.

In contrast to the first embodiment, on the upper longitudinal end 13 of the plug connector 10', the contact sections 14' are not configured to be angular in shape but rather consist of four plates arranged in pairs in the same orientation next to each other.

The features of the described embodiments can be combined at the discretion of a person skilled in the art.

The invention claimed is:

1. An electric plug connector comprising two separate contact members, each of said contact members having a first pair of parallel elongate webs spaced from each other and a second pair of elongate webs that extend in the same plane perpendicular to said first pair of webs, said first and second contact members being assembled so that said first pairs of webs of both contact members are aligned to define a first flat plug-in channel and said second pairs of webs of both contact members are spaced from each other and face each other to define a second flat plug-in channel perpendicular to and crossing said first plug-in channel, said two separate contact members being held in an assembled condition by a holding member tightly surrounding said contact members.

2. The electric plug connector according to claim 1, wherein said holding member is a spring wire.

3. The electric plug connector according to claim 1, wherein said holding member is a metallic ribbon.

4. The electric plug connector according to claim 1, wherein said contact members have external cutouts aligned with each other to form a peripheral groove in said assembled condition for accommodation of said holding member.

5. The electric plug connector according to claim 1, wherein each of said contact members contains two integrally connected segments, each segment including one of said first pair of elongate webs and one of said second pair of elongate webs.

6. The electric plug connector according to claim 1, wherein said contact members are stamped from a blank.

7. The electric plug connector according to claim 1, wherein said contact members are assembled around a male connector partially engaged in at least one of said plug-in channels, said holding member also surrounding and engaging said male connector.

8. The electric plug connector according to claim 7, wherein said male connector is cross-shaped in cross-section and is engaged in both plug-in channels.

* * * * *